United States Patent [19]

Hill

[11] Patent Number: 4,790,788

[45] Date of Patent: Dec. 13, 1988

[54] AERIAL TOY

[76] Inventor: Jerry M. Hill, 34-2137 West 1st, Vancouver, British Columbia, Canada

[21] Appl. No.: 147,292

[22] Filed: Jan. 22, 1988

Related U.S. Application Data

[63] Continuation of Ser. No. 822,633, Jan. 27, 1986, abandoned.

[51] Int. Cl.[4] ..... A63H 27/00; A63H 27/08; A63B 57/00; B64C 5/00

[52] U.S. Cl. ..... 446/61; 446/34; 273/425; 244/34 A; 244/153 R

[58] Field of Search ..... 446/34, 46, 48, 61, 446/66, 67, 68; 102/503; 273/425, 424, 428; 244/12.6, 21, 34 A, 153 R, 153 A

[56] References Cited

U.S. PATENT DOCUMENTS

| | | | |
|---|---|---|---|
| 2,678,804 | 5/1954 | Lebourg | 102/503 X |
| 2,933,266 | 4/1960 | Zborowski | 244/34 A X |
| 3,017,139 | 1/1962 | Binder | 244/12.6 |
| 3,264,776 | 8/1966 | Morrow | 446/34 |
| 3,982,489 | 9/1976 | Flatau et al. | 102/503 X |
| 4,151,674 | 5/1979 | Klahn et al. | 446/34 |
| 4,246,721 | 1/1981 | Bowers | 446/61 |
| 4,390,148 | 6/1983 | Cudmore | 273/425 X |
| 4,568,297 | 2/1986 | Dunipace | 446/46 |
| 4,687,210 | 8/1987 | Michel | 273/428 X |

*Primary Examiner*—Robert A. Hafer
*Assistant Examiner*—D. Neal Muir
*Attorney, Agent, or Firm*—Dennison, Meserole, Pollack & Scheiner

[57] ABSTRACT

An aerial toy comprising a body having a leading edge and a trailing edge, and comprising a flexible, resilient, thin wall sail or airfoil extending forward from the trailing edge; a relatively thick, relatively rigid peripheral ring at the leading edge, the toy having a ratio of body length to body diameter of between 1:1.25 and 1:1.35; a ratio of body diameter to leading edge thickness of about 30:1; a ratio of ring length to overall body length of about 1:3.66; and a ratio of leading end weight to trailing end weight of 2.2:1.

6 Claims, 3 Drawing Sheets

AERIAL TOY

This is a continuation of co-pending application Ser. No. 822,633 filed on Jan. 27, 1986, now abandoned.

FIELD OF THE INVENTION

This invention relates to aerial toys.

DESCRIPTION OF THE PRIOR ART

Toys such as model aeroplane, kites and boomerangs have been known for many years. Of more recent popularity, are flying discs such as those available under the trade mark Frisbee, which exhibit a floating, graceful flight. Several attempts have been made to produce simple tubular bodies that can be thrown and whose flight is protracted because the tube exhibits airfoil characteristics. Examples of such devices are shown in U.S. Pat. Nos. 4,151,974 to Klahn et al.; 3,264,776 to Morrow and 4,246,721 to Bowers.

However such devices have not made any commercial impact. The present inventor has observed that, in the main, their flight is unpredictable. Further more the airfoil characteristics of the tube are relatively easily lost. For example small dents formed in the tube can spoil its characteristics. As these devices frequently fall to the ground, rather than being caught, the denting of them is a relatively common occurrence. Another failing that has been observed is the inability to achieve a consistent flight. That is the flight characteristics cannot be predicted. It is believed that an appeal of the flying discs, such as the Frisbee referred to above, it that its flight is consistent, depending on the manner in which the device is thrown and that considerable skill can be displayed in throwing the device in a manner that ensures a desired flight.

SUMMARY OF THE INVENTION

The present invention provides an aerial toy of simple cross section that exhibits excellent flight characteristics and whose flight is consistent and predictable.

Accordingly the present invention is an aerial toy comprising a body having a leading edge and a trailing edge, and comprising a flexible, resilient, thin wall sail or airfoil extending forward from the trailing edge; a relatively thick, relatively rigid peripheral ring at the leading edge, the toy having a ratio of body length to body diameter of between 1:1.25 and 1:1.35; a ratio of body diameter to leading edge thickness of about 30:1; a ratio of ring length to overall length of about 1:3.66; and a ratio of leading end weight to trailing end weight of 2.2:1.

The cross section of the aerial toy may be circular or polygonal or, indeed, be selected from a wide variety of shapes.

The sail thickness is, for example, about 20 mil.

DRAWINGS

Aspects of the invention are illustrated, merely by way of example, in the accompanying drawings in which.

Figure 5A:
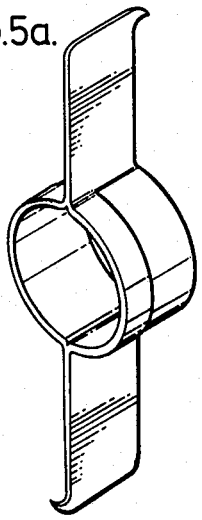
Figure 5B:
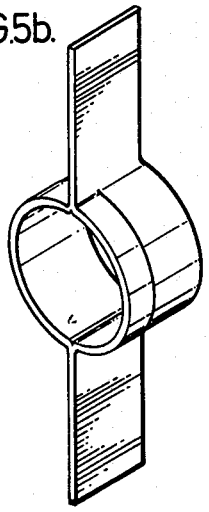
Figure 5C:
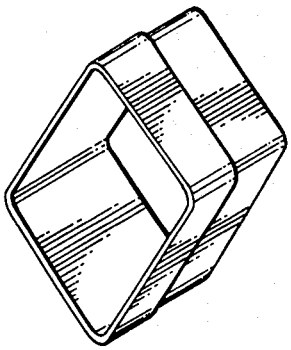
Figure 5D:
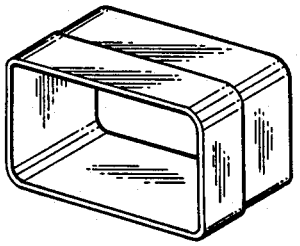
Figure 5E:
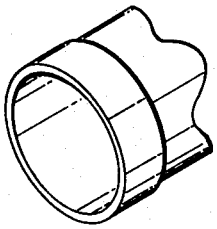
Figure 5F:
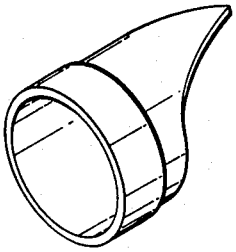
Figure 5G:
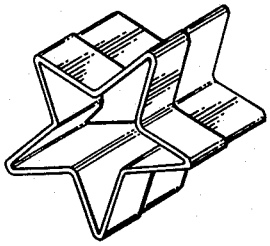
Figure 5H:
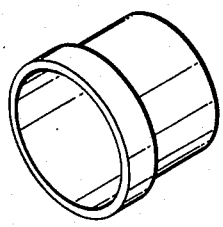
Figure 5I:
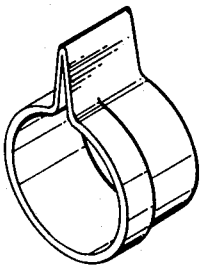
Figure 5J:
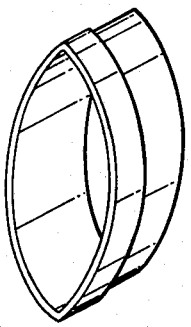
Figure 5K:
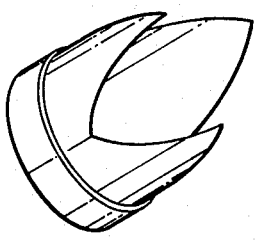
Figure 5L:
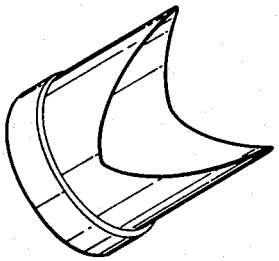
Figure 5M:
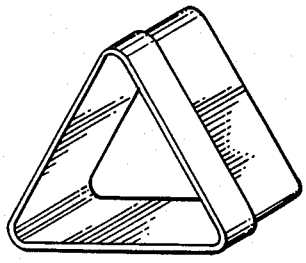
Figure 5N:
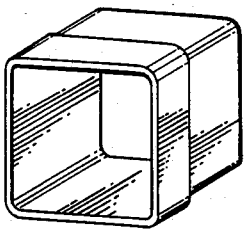
Figure 5O:
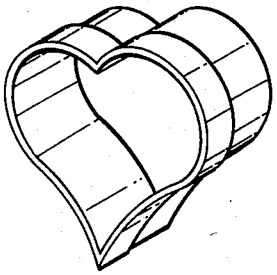
Figure 5P:
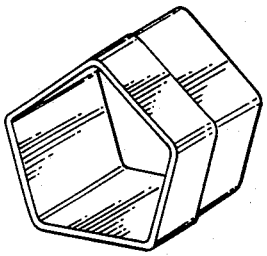

FIGS. 5*a* to 5*p* show the wide variety of possible cross sectional shapes.

p DESCRIPTION OF THE PREFERRED EMBODIMENTS

Figure 1:
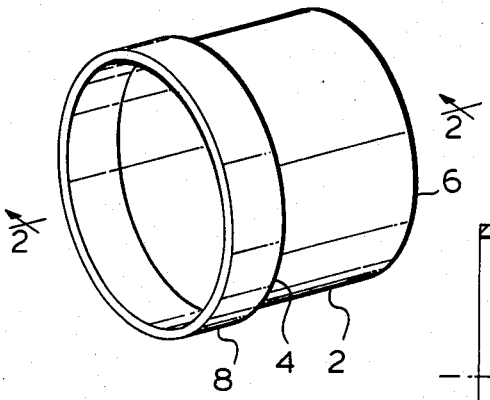
FIG. 1 is an isometric view of an aerial toy according to the present invention.
Figure 2:
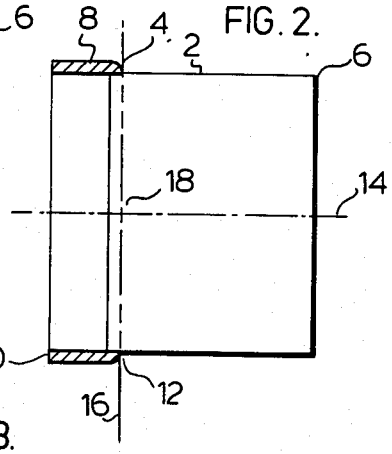
FIG. 2 is a section on the line 2—2 in FIG. 1.

Referring to the drawings FIG. 1 shows an aerial toy compromising a flexible, thin walled cylindrical body or sail or airfoil 2 of uniform wall thickness. There is a leading edge 4 and a trailing edge 6.

The leading edge 4 of the cylindrical body 2 merges into a relatively thick peripheral ring 8, formed on the exterior of the toy. It is important, according to the present invention, that the ratios of the various dimensions of the aerial toy be as follows.

The ratio of the length of the cylinder to the diameter of the cylinder must be between 1:1.25 and 1.35. The ratio of the diameter of the cylinder to the thickness of the ring must be about 30:1 and the ratio of the ring to the overall length of the cylinder must be about 1:3.66. These relative dimensions have been evolved over considerable time with large amounts of experimental variations and are believed to be the reason the device of the present invention exhibits excellent flight characteristics.

It should also be noted that the thin walled tubular body is of uniform wall thickness as far as that is possible to achieve. The straight interior surfaces (with constant interior cross section) results in smoother air flow through the toy and more easily controlled flight. Furthermore the device is flexible which prevents damage on landing but also facilitates flight of the toy, particularly the launching of the toy. The toy must be flexible enough to rebound to normal shape after being stepped on it should take approximately one pound force to squeeze the trailing edges together.

Figure 3:
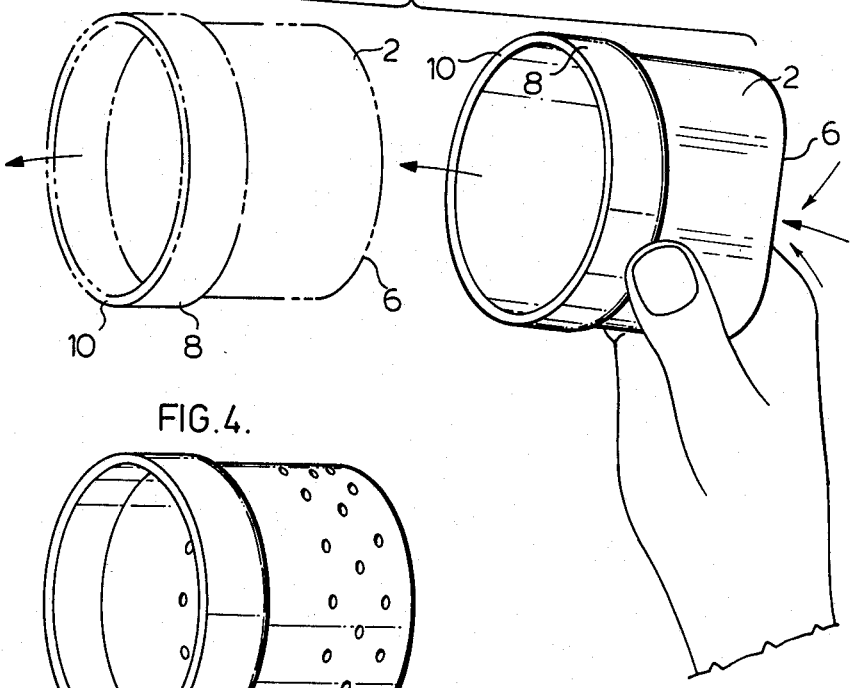
FIG. 3 illustrates the launching of the toy.

As shown in FIG. 3 to throw the illustrated toy the thrower compresses the toy to where the trailing sides may meet and throws it with a rifling action, that is in the overhanded or sidearm motion of a football. As the toy is released the flexible cylinder rebounds to its rest or open shape, as it leaves the thrower's fingertips, which improves the spin significantly resulting in greater stability, directional control and distance of flight.

The thin walled, tubular sail 2 provides the lift and the directional stability of the toy. It should be noted that the necessary spinning action can be imparted more easily if the tube is of polygonal cross section or ridged. The peripheral ring 8 at the leading edge of the toy is relatively large and also relatively soft. This feature of the device does not form a hazard if, for example, it should hit somebody. The stronger ring provides necessary structural strength that the thin walled cylinder does not possess. The weight of the ring improves the flying characteristics of the toy. Air flow over the toy is improved by a chamfered leading edge 10 for the ring 8 and a trailing edge 12 that merges gradually into cylinder 2. This ensures a uniform predictable flight.

Figure 4:
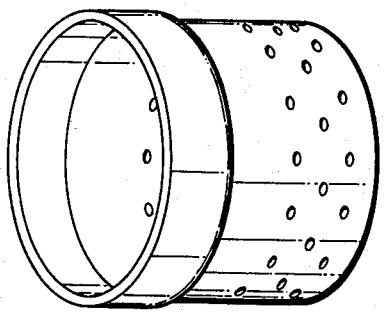
FIG. 4 shows a variation.

The thin walled cylinder, airfoil or sail 2 may have a thickness of about 20 mil. This, of course, is extremely flexible but resilient. The leading ring however provides the necessary structural strength and is not normally compressed on throwing the toy. It can be desirable to provide rifling on the interior surface to improve the flight characteristics, in particular, air flow through the cylinder. The exterior may also have ridges for gripping ability. As shown particularly in FIG. 4 apertures may be formed in the body so that it may produce a whistling as the toy flies through the air.

FIGS. 5g to 5p are included to show the wide variety of cross sectional shapes possible with the toy of the present invention. Attention may be directed to embodiments such as 5k or 5i where the formation of the irregular trailing edge permits slight variations of the weight ratio, should that prove to be necessary.

I claim:

1. A hand launched aerial toy consisting of a hollow open-ended resilient deformable body including forward and rearward body sections having a diameter greater than its length, said rearward body section constituting a relatively thin walled sail means, said thin walled sail means having a substantially constant thickness said forward body section being substantially axially shorter than said rearward section and of radially thicker construction and configured to define a linear substantially constant interior cross section with said rearward body section, said forward body section being of a greater external diameter than said rearward body section, said toy body being of substantially uniform internal diameter throughout its length, said forward body section including a chamfered leading edge and a diminishing external thickness adjacent the point of interconnection with said rearward body section and including a smooth outer surface to define a total external surface of greater size than said linear substantially constant interior cross section, and wherein said forward body section comprises an external airfoil, and wherein said toy body defines a configuration to create an interior high pressure region and an external low pressure region when launched through the air, and a relative length relationship is established between said forward and rearward body sections to place the longitudinal center of gravity at substantially the point of interconnection between said forward and rearward body sections.

2. An aerial toy as claimed in claim 1 constructed from a supple plastic material.

3. An aerial toy as claimed in claim 1 having a generally cylindrical configuration.

4. An aerial toy as claimed in claim 1 having a ratio of body length to inside body diameter of between about 1 to 1.25 and 1 to 1.35.

5. An aerial toy as claimed in claim 1 having a ratio of forward body section overall length of between about 1 to 3.66.

6. An aerial toy as claimed in claim 1 having a ratio of forward body section to rearward body section weight of about 2.2 to 1.

* * * * *